US005545295A

United States Patent [19]

Fujita et al.

[11] Patent Number: 5,545,295

[45] Date of Patent: Aug. 13, 1996

[54] WEB TRANSFER DEVICE

[75] Inventors: Norio Fujita, Mihara; Hiroshi Iwata, Hiroshima; Haruyoshi Fujiwara, Mihara, all of Japan

[73] Assignee: Mitsubishi Jukogyo Kabushiki Kaisha, Tokyo, Japan

[21] Appl. No.: 218,043

[22] Filed: Mar. 25, 1994

Related U.S. Application Data

[63] Continuation-in-part of Ser. No. 939,784, Sep. 3, 1992, abandoned.

[30] Foreign Application Priority Data

Sep. 4, 1991 [JP] Japan ..... 3-250258

[51] Int. Cl.[6] ..... D21F 3/00

[52] U.S. Cl. ..... 162/358.1; 162/360.3; 162/306

[58] Field of Search ..... 162/358.1, 358.3, 162/358.4, 359.1, 360.2, 360.3, 306

[56] References Cited

U.S. PATENT DOCUMENTS

| | | | |
|---|---|---|---|
| 4,016,032 | 4/1977 | Kankaanpaa | 162/360.3 |
| 4,056,433 | 11/1977 | Koponen et al. | 162/360.3 |
| 4,086,131 | 4/1978 | Rempel et al. | 162/360.3 |
| 4,359,827 | 11/1982 | Thomas | 162/359.1 |
| 4,483,745 | 11/1984 | Wicks et al. | 162/358.3 |
| 4,526,655 | 7/1985 | Karvinen et al. | 162/360.2 |
| 4,559,258 | 12/1985 | Kiuchi | 162/358.4 |
| 4,752,519 | 6/1988 | Boyer et al. | 162/900 |
| 4,880,501 | 11/1989 | Schiel | 162/358.4 |
| 5,178,732 | 1/1993 | Steiner et al. | 162/358.3 |

*Primary Examiner*—Karen M. Hastings

[57] ABSTRACT

A web transfer system is disclosed which comprises an endless belt which has a first surface which is elastic and which is structured and arranged to come into direct contact with a web in a press section and a second surface which is not in contact with the web. The endless belt has an inner core, which is located between the first surface and the second surface. The inner core is made from a material which is less elastic than the first surface. The web transfer system also comprises a hard roll and at least one pressure roll which presses the endless belt into direct contact against the hard roll. When the endless belt is pressed against the hard roll, it is deformed so as to doff the web from the hard roll directly and convey the web with the endless belt. No suction force is imposed on the endless belt.

6 Claims, 10 Drawing Sheets

WEB TRANSFER DEVICE

This is a continuation-in-part of application Ser. No. 07/939,784 filed Sep. 3, 1992, now abandoned.

FIELD OF THE INVENTION

The invention relates to a press section of a paper making machine and more particularly to an improvement of a web transfer device in the press section.

BACKGROUND OF THE INVENTION

Generally, the job of the press section in paper-making is to put roll-pressure on the web which has been dewatered to 15–18% in fiber dryness in the upper stream process, the wire section and to raise its fiber dryness to 40–45% before transfer to the next process, the dryer section.

FIG. 9 depicts one example of a high speed conventional press device used in the press section. In this example, web 2, having a moisture content of about 80% emerges from wire section 1. The web is then stuck to pickup felt 4 and sucked upon by suction pickup roll 3, then dewatered upside and downside in the first press 1P made up of the felt 4, 1P felt 5, suction roll 6, and first grooved roll 7*a* by porous felts 4 and 5, as indicated by arrows A and B. The web 2 is then held on the pick up felt 4 while it is sucked up by the vacuum of suction roll 6 and dewatered at the second press 2P of single felt comprising a hard roll whose surface is smooth, namely, press center roll 8*a*, which is granite roll or artificial stone cover roll or rubber cover roll and second grooved roll 7*b* leaving moisture absorbed by pickup felt 4. Here web 2 is transferred from pickup felt 4 to a more elaborate press center roll 8*a* and its moisture is reduced to 55–60% by the third press 3P comprising roll 8*a* and third grooved roll 7*c*. It is moved to the next press (the fourth press) or the next process, drying.

The operations of passing web in the above-described system is outlined as follows: Web 2, dehydrated by third press 3P, is stuck onto the surface of center roll 8*a*, doffed by doctor 10 and is temporarily dropped into full-width press pit 11, as shown by 2'. Because this state makes it difficult to feed a full-width web into the next stage press or the dryer section, the method adopted here is to feed a narrow web (tail) first and then widen it to the required width. The first operation is to produce a tail of any width on the wire section using a high-pressure water jet (not illustrated). After either or both of paper roll 15 and lead-in felt roll 17 is moved to the position indicated by a dotted line, as shown by 15' and 17' on FIG. 8, to secure sufficient space for the tail to pass easily through, air is blown off the air nozzle of carrier jet 19, doffing tail from press center roll 8*a*, putting it on felt 21 for transport to the next-stage press, as shown by 2".

FIG. 10 describes the operations with web 2 being moved from the conventional press center roll 8*a* to the next fourth press felt 21.

In FIG. 10, the web 2, dehydrated by 3P felt 9, is pressed hard against the side of press center roll 8*a* due to dehydration or, to be more precise, is stuck onto it. The web 2, stuck on the press center roll 8*a*, needs to be doffed before it is transferred to the following stage press. Consequently the following stage press is operated faster than the previous process. This additional speed is called "draw".

The draw generates tension in the web and the consequent force pulls the web off the press center roll, as opposed to adhesion. A tensile force commensurate with the draw acts on the full width of the open draw part (portion of the web not supported by felt or roll). This tension stretches the web. The part of the web that is extended is primarily on the area which peels off, the place where pull grows, but dilation varies from part to part because of the uneven fabric quantity, dispersion and additive distribution, producing an uneven strain. If the web is partially destroyed, it is broken off full breadth. The extent of the partially focused elongation increases in proportion to the length of the open draw, raising the risk of paper breakage. It is therefore necessary to shorten the open draw section as much as possible.

An example with such steps is illustrated in FIG. 11. Press center roll 8*a* and suction roll are laid out to make the open draw part as short as possible and limit it to only one place. In FIG. 11, when the suction roll is pressed against press center roll 8*a*, aiming it at the open draw to prevent paper breakdown, one will discover that felt and canvas are wound around the suction roll at the same speed as the press center roll. However, no draw will result, the pull of the web being insufficient to peel itself from the center roll. The vacuum pressure of the suction roll doffs the paper only after nipping because of insufficient ventilation of the press center. Consequently, it is impossible to peel the web from the press center roll only with the vacuum pressure of the suction roll, leaving the web stuck on the press center roll due to its adhesion. To tear the web from the press center roll, there must therefore be a draw in place and there is no option but to retain the minimum open draw. After all, a fundamental solution remains to be found to the earlier question of paper breakage.

Paper making machines have become impressively faster in recent years; some conventional newsprint machines operate at a speed of about 1,300 meters per minute. There is a growing need for operations which run at 1,500 meters per minute. One stumbling block to the faster operations of paper making machines is the question of transferring the web from one press to another and from the press section to the dryer.

As explained, the method previously used was to peel the tail of the web with the air nozzle as described above before transfer to the next process. In faster operations however, the web becomes more difficult to doff from the press center roll. To remove the web from the press center in a stable manner, it is necessary to produce a larger draw between presses or the press and the dryer. The web after the press part is 40–45% consistency and its strength is very low compared with dry paper, and is not supported with felt or any others while it is in the above sections. Because of the so-called open draw, paper is apt to break if the draw gets larger. Even if paper is passed through the whole system and normal operations are started, the paper is easily broken by fluctuations.

It is therefore an object of the present invention to provide a web transfer device which better transfers the rolls from one press to another.

Another object of the invention is to provide a web from the press section to the draw.

Still another aspect of the invention is to provide a web transfer device which the paper is not easily broken.

SUMMARY OF THE INVENTION

These and other objects of the invention, which shall become hereafter apparent, are achieved by the present web transfer device in which an elastic belt is used to tear off the web from the hard roll (the press center roll or the top roll).

The thinning of the belt, which occurs when it is pressed against the hard roll, is exploited to expand the surface of the said belt by that marking and to create a gap between the web and the hard roll. To shuck off the web from the hard roll to the belt side or to transfer the web stuck on the belt to the next felt or canvas, grooves or small orifices are created in the direction of the circumference in advance on the surface of the belt, press the vacuum box covered with the next stage, the felt or canvas, against the web, and transfer the web to the next stage, the felt or canvas, by means of air pressure passing through the web. The side in contact with the web of the web transfer device mounted on the paper making machine press is therefore elastic, while the other side has an endless belt made of a less elastic material and a hard roll, as well, placed opposite the belt. The belt is pressed against the hard roll by the web so that the belt may be deformed to take the web from the hard roll and convey it on the belt. The surface of the elastic belt which meets the web travels constantly while remaining applied on the web and travels as fast as the web or faster at an increasingly high speed, particularly because the elastic belt is no longer subject to deformation at and after the point of maximum pressure with the result that enough tension is generated with a zero open draw to doff the web from the press center roll.

BRIEF DESCRIPTION OF THE DRAWINGS

The invention will be better understood by the Detailed Description of the Preferred Embodiment, in conjunction with the drawings, of which.

DETAILED DESCRIPTION OF THE PREFERRED EMBODIMENTS

Figure 1:
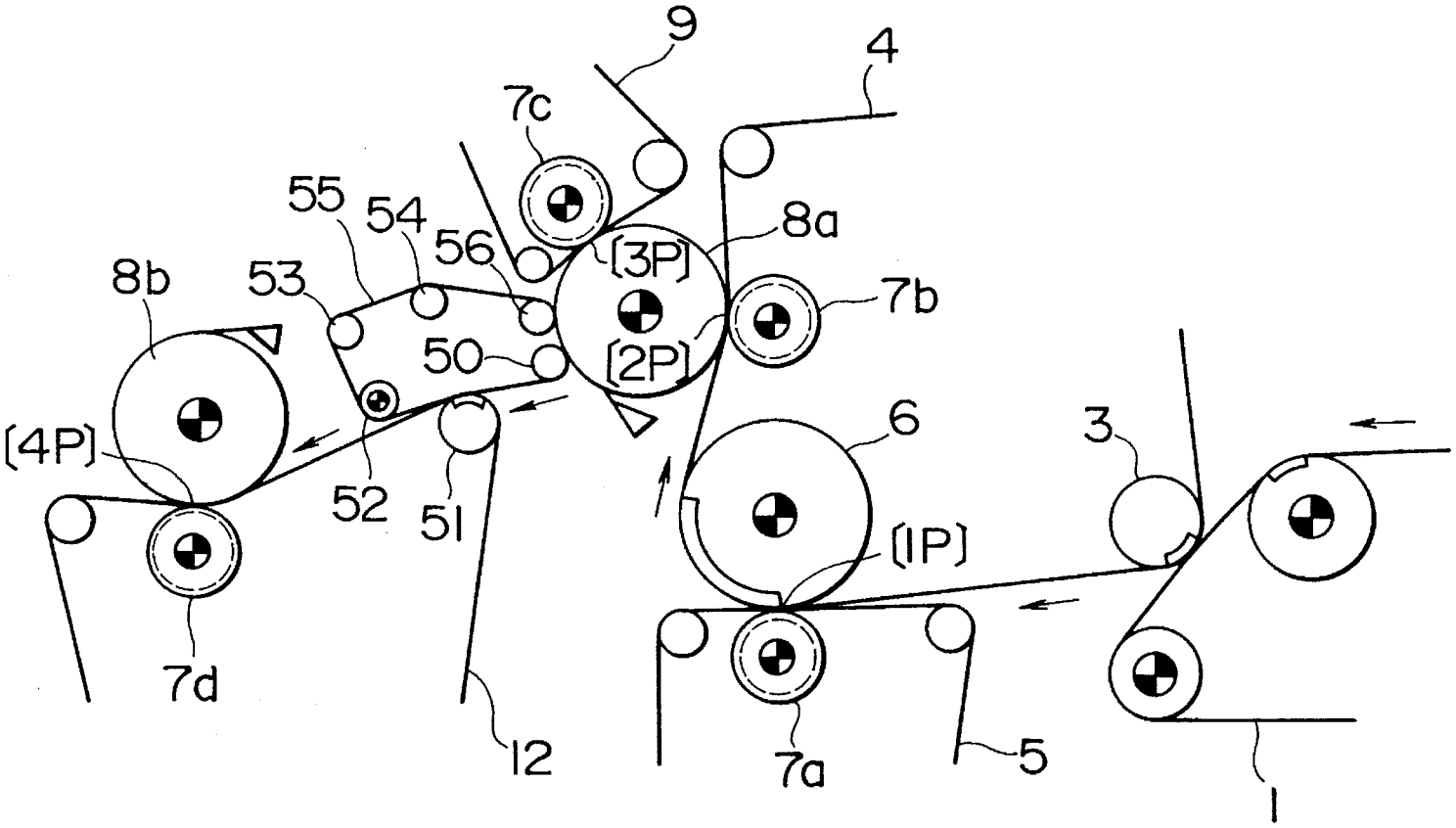
FIG. 1 is a schematic side view of the web transfer system used in a first example.

Referring now to the drawings, wherein like numerals reflect like elements throughout the several views a web transfer device in the press section of the paper making machine is disclosed.

FIGS. 1–7 illustrate examples in which the invention is implemented. FIG. 1 depicts a web transfer device in the press section of a paper making machine from a third press (3P) to a fourth press (4P). In FIG. 1, the web, produced in a wire section is sucked up and stuck on pickup felt 4 by a vacuum working on suction pickup roll 3 and is transferred, deposited on press center roll 8*a*, the hard roll following the third press (3P). The web transfer system, which supplies web 2 from press center roll 8*a* to the next process, comprises the following elements: an elastic endless belt 55, pressure rolls 50 and 56 to apply said belt on press center roll 8*a* by way of the web, belt drive roll 52 to move said belt, tension roll 53 to provide pull to the belt, belt guide roll 54 and a pressure device, not illustrated, to press pressure rolls 50 and 56 onto press center roll 8*a*. In the above arrangement, it is also possible to put pressure roll 56 in a place where the belt engages center roll 8*a* with the elastic belt kept from thinning.

Figure 2:
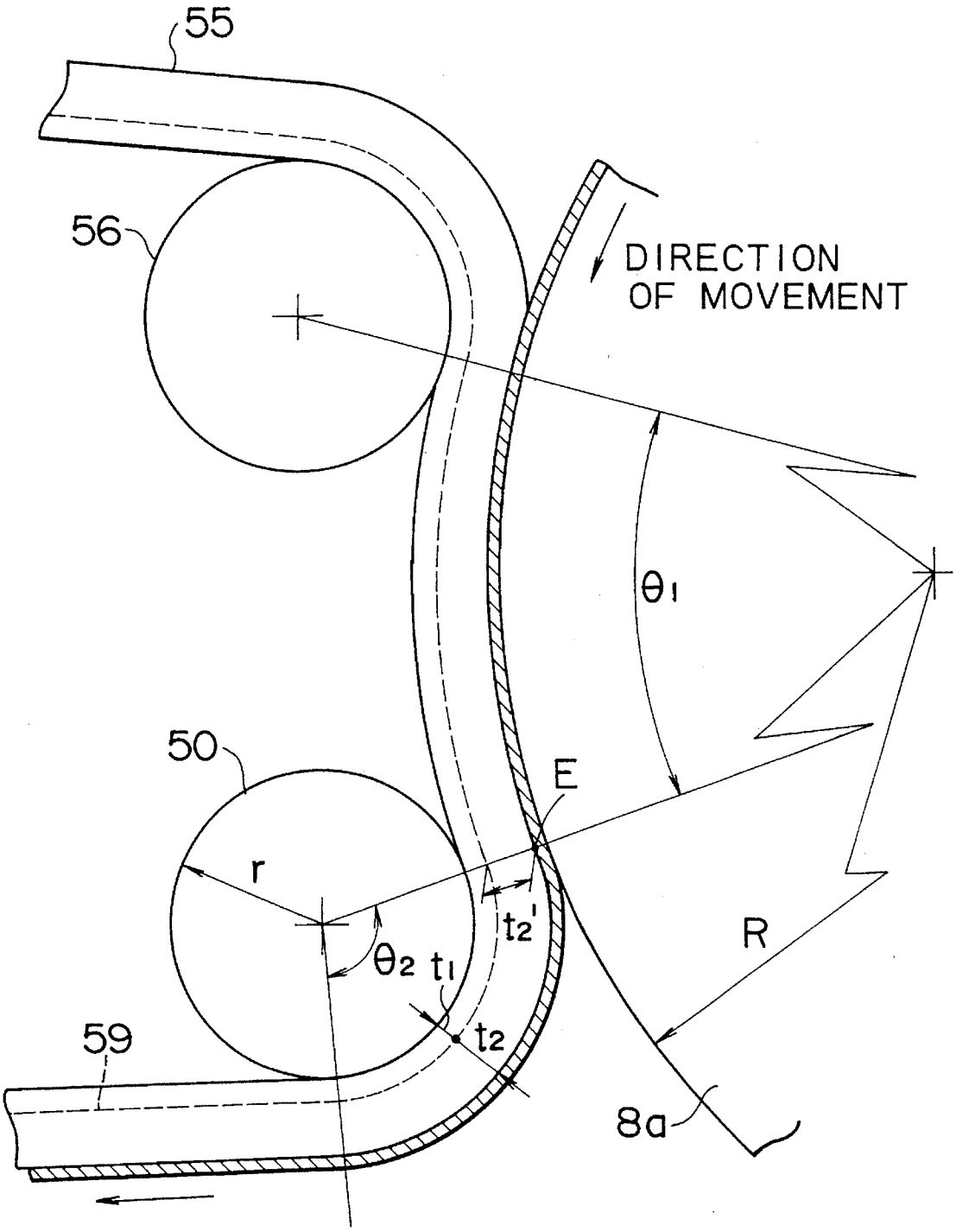
FIG. 2 is a schematic explanatory drawing describing the movement of the web from the hard roll (press center roll) in FIG. 1 to the belt.

Explained next are the operations in which the web is doffed from press center 8*a* in the above arrangement. In FIG. 2, when elastic belt 55 with a less elastic core 59 is put at a position $t'_2$ far from the surface in contact with the web, to be pressed against press center roll 8*a*, the traveling speed of the elastic belt becomes constant. The surface speed of the belt which finds itself in contact with the web becomes the same as the surface speed of the center roll in the section where the belt is thrust against the press roll. The core speed without considering the thickness of the paper is determined by the following equation:

$$\text{Core speed} = V \times \frac{R + t_2}{R},$$

where

V=surface speed of press center roll 8*a*,

R=its radius, $t_2$=the distane from the core from the point of contact with paper at the center line of the nip.

Meanwhile, in $\theta_2$ area from nip point E formed with press center roll 8*a* and pressure roll 50 to the point where the belt moves away from pressure roll 50, the surface speed of the side of the belt which is in contact with the web can be computed as follows:

$$\text{Belt surface speed} = \text{core speed} \times \frac{r + t_1 + t_2}{r + t_1}$$

r=radius of pressure roll 50, $t_2$=the distance from core 59 to the surface of the belt at $t_2$, $t_1$=the distance from core 59 to the back side of the belt.

Generally because of $R \gg t'_2$ in the area of $\theta_2$, the belt surface speed is approximately:

$$\left(1 + \frac{t_2}{r + t_1}\right) V$$

In the conventional cases where the web is peeled off with an open draw, the draw is normally 3–4% or under, so a sufficient amount of draw may be obtained to remove the web from the center roll, if $t_2/(r+t_1)$ is set at about 10%, considering possible slippage between the belt and the web. If the web draw is to be controlled, all one must do is adjust the slide of the web on the belt surface by manipulating the thrust force of the press center roll of the pressure rolls and changing the thickness ($t'_2$) of the belt.

Figure 4:
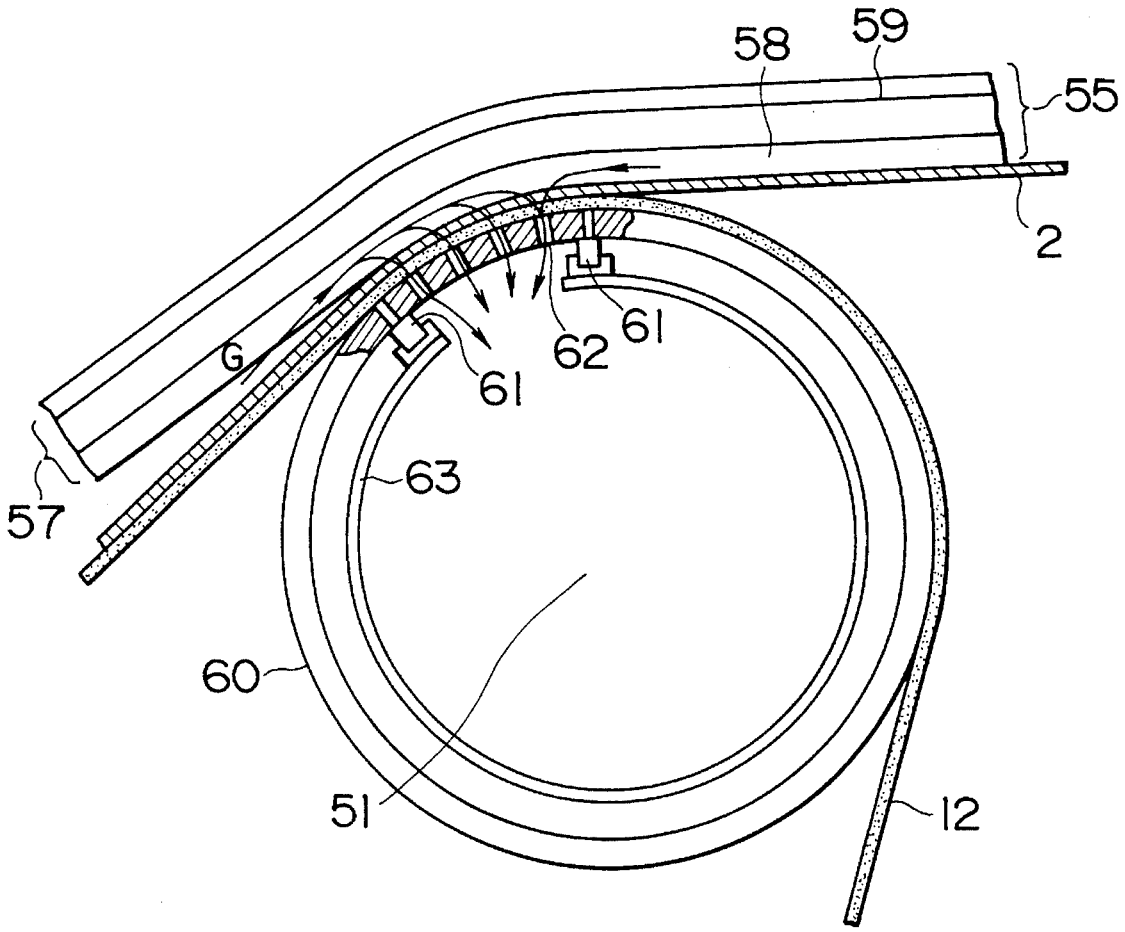
FIG. 4 is an explanatory schematic description of the transfer of the web from the said belt to the next felt.
Figure 5:
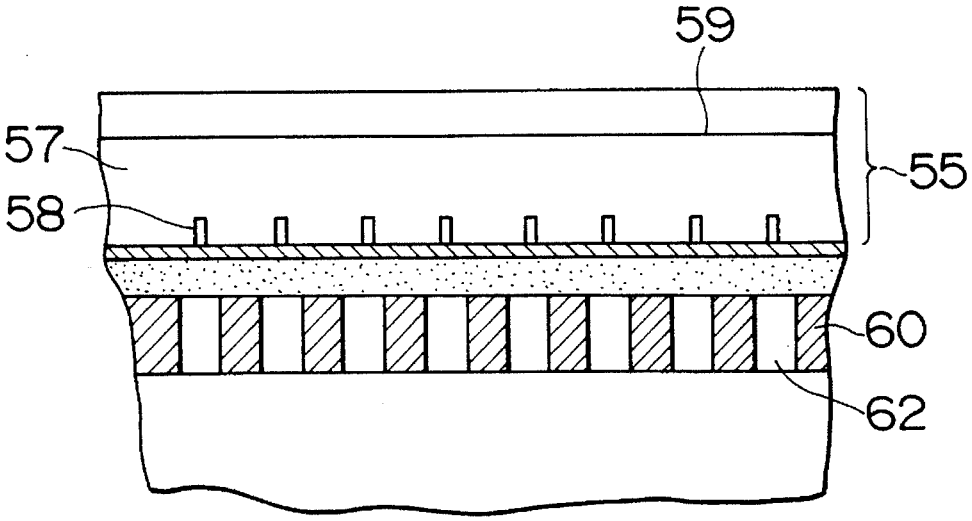
FIG. 5 is a cross-sectional view of the operations of transferring the web from the said belt to the next felt.
Figure 6:
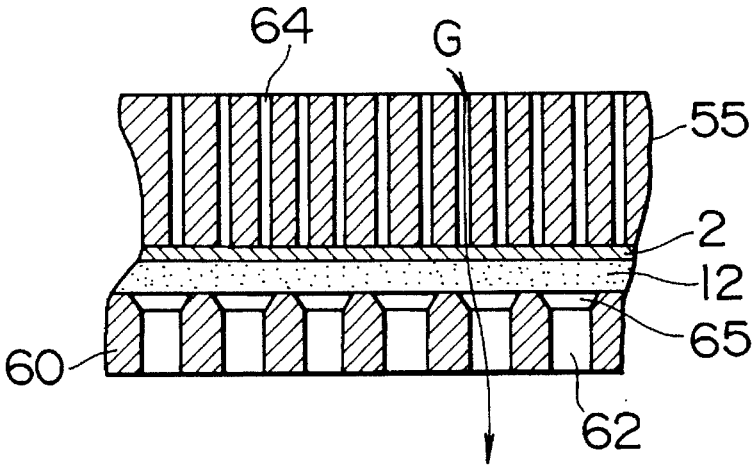
FIG. 6 is a cross-sectional view of other examples of the structure of the belt as the web is conveyed from the same belt to the next felt.

FIG. 4 depicts the way the web is transferred from belt 55 to 4P felt in the after process of the aforementioned web transfer unit. In FIG. 4, 4P felt 12 is pressed against the belt by vacuum roll 51. The vacuum roll comprises shell 60 with numerous orifices 62, vacuum box 63, and seal packing 61 intended to prevent air leaks between the vacuum box and the cell. A vacuum pump, not illustrated, is connected by a pipe to vacuum box 63. Belt 55 comprises two elements, one being core 59 reinforced with strength wirecrosses that are less liable to be dilated when exposed to pull and the other, elastic part 57, which is allowed to contract or extend in an elastic manner. Groove 58 (FIG. 5) is created at the circumference on the surface of elastic part 57 and runs in several lines breadthwise. Elastic part 57 is constructed so as to grow harder and less elastic as it approaches the composition plane with core 59, without breaking away from the core. If a vacuum force acts on vacuum roll 51, air G passes through several lines of groove 58 and then through web 2 and 4P felt 12, to flow into vacuum box 63. This air flow, passing through the web, transfers the web deposited on the belt to 4P felt 12 and to the next stage, the fourth press. The example of the belt shown in FIG. 4 describes grooves created along the circumference, but grooves can be substituted by holes 64 which penetrate the belt, as shown in FIG. 6. In FIG. 6, holes in vacuum roll shell 60 can be shaped like dish hole 65 to obtain a larger contact area with the felt, which makes it double sure that the web is transferred to the felt side.

Figure 7:
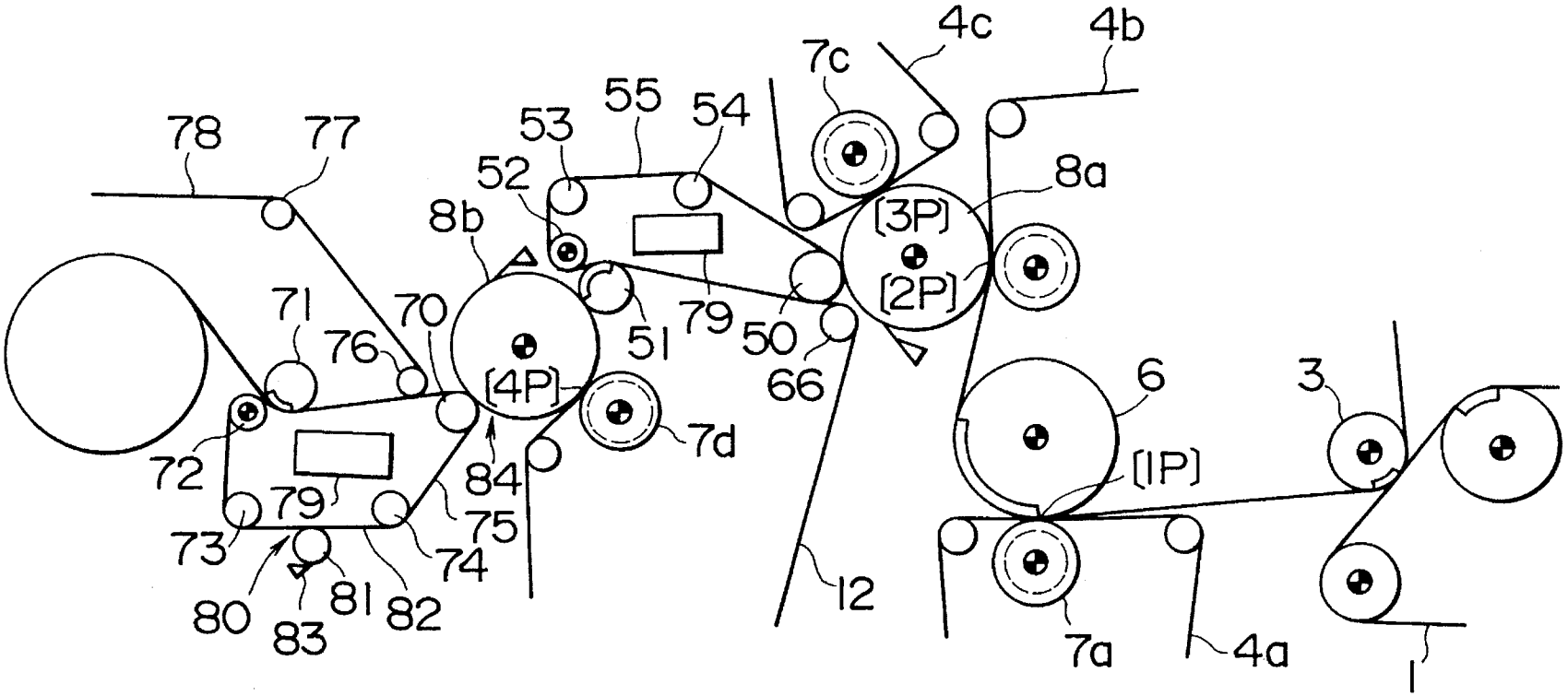
FIG. 7 is a schematic profile of the web transfer system in a second embodiment, depicting how the invention is used.
Figure 8:
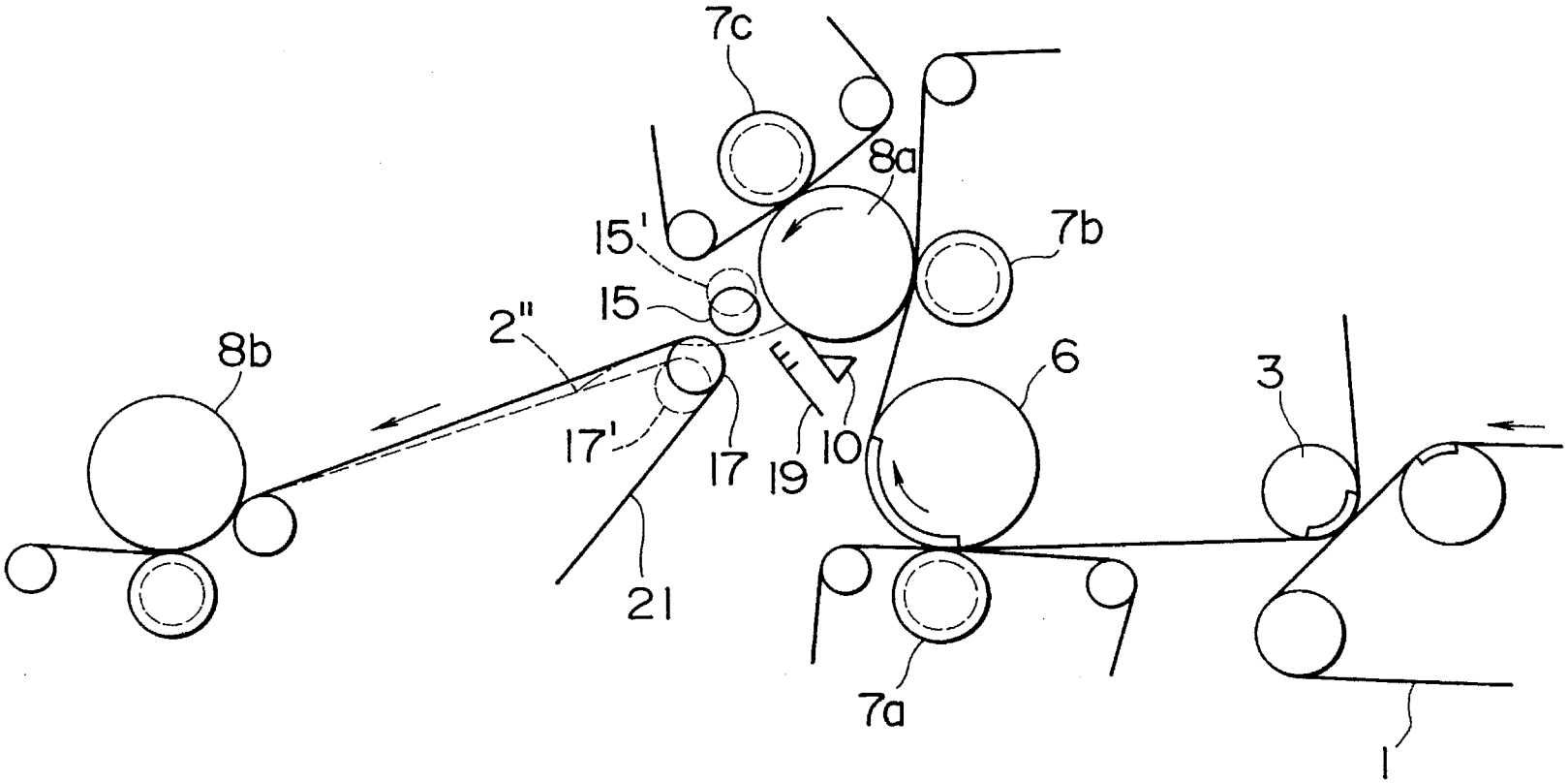
FIG. 8 RELATED ART
FIG. 8 is a side view of the conventional operations of passing the paper.
Figure 9:
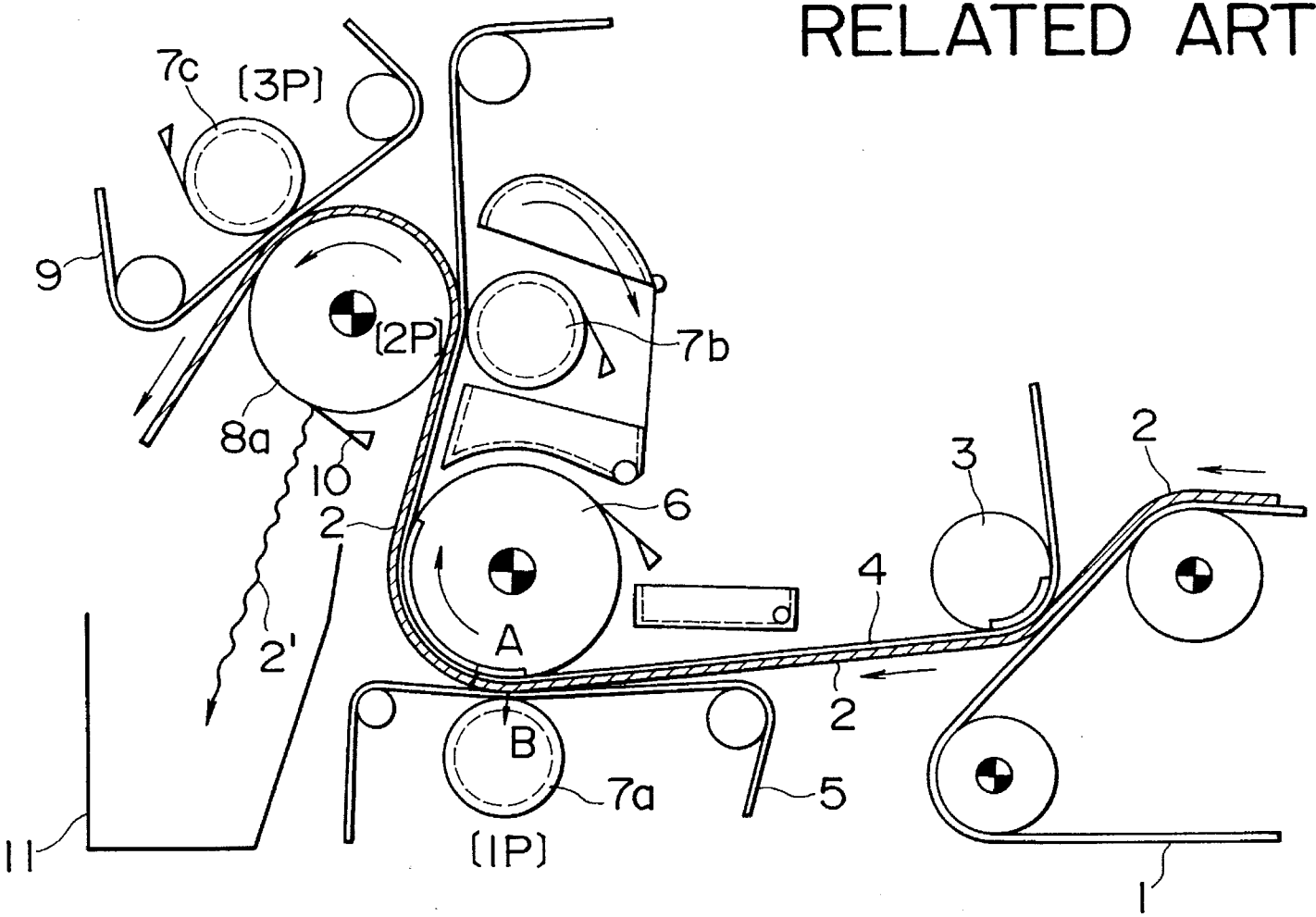
FIG. 9 RELATED ART
FIG. 9 is a side view of the relationship between the web and the press unit in the conventional press section.
Figure 10:
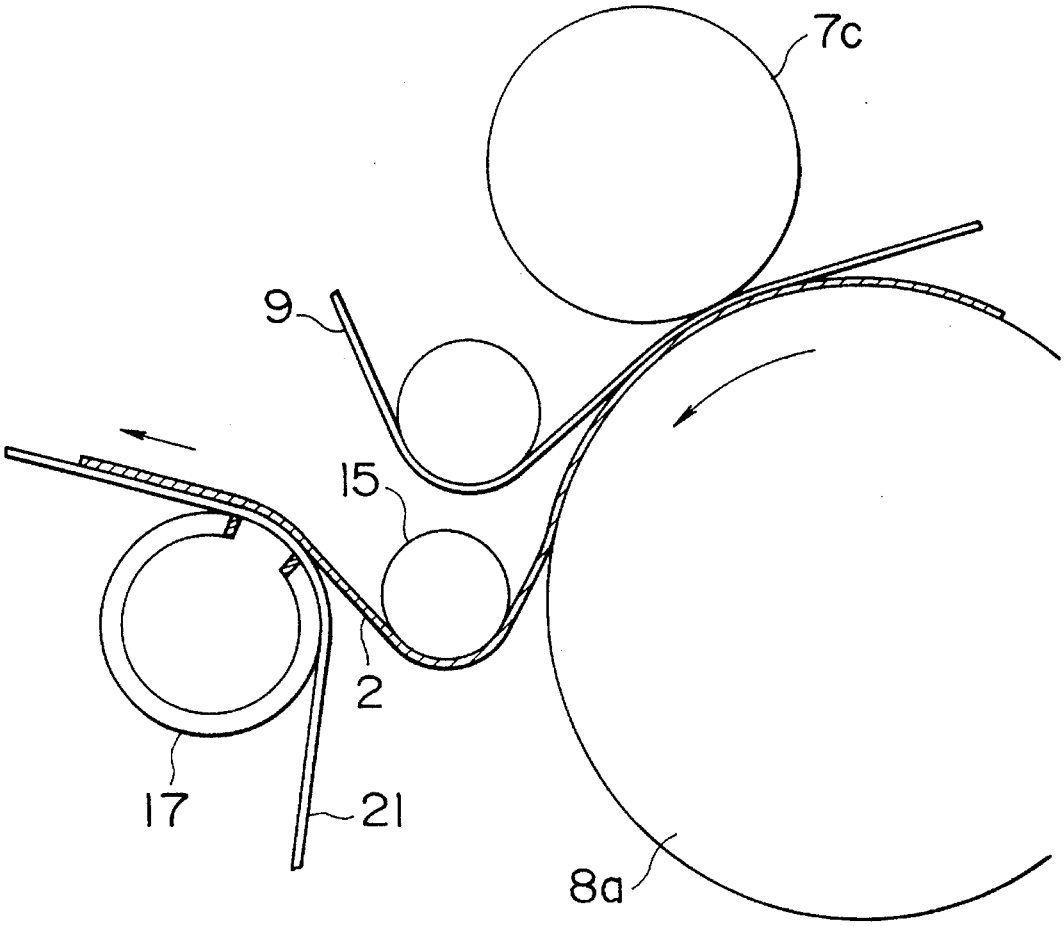
FIG. 10 RELATED ART
FIG. 10 is a schematic profile of a conventional paper passing mechanism.
Figure 11:
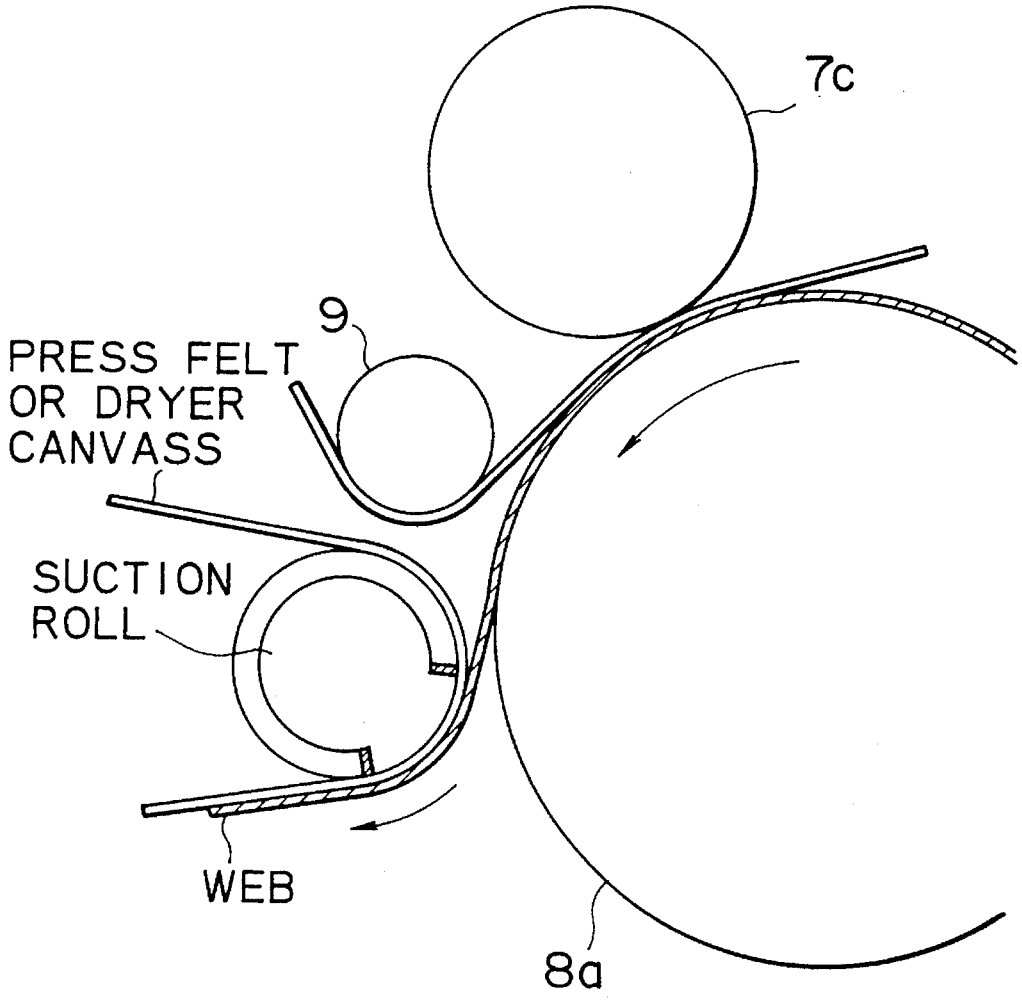
FIG. 11 RELATED ART
FIG. 11 is a profile of the conventional paper passing mechanism.

Described next is a second example of how the invention is used. This second example is different from the first example in that the belt is pressed against press center roll 8*a* by one pressure roll 50 to doff the web from the press center roll. In FIG. 7, one pressure roll 50 is pressed against press center roll 8*a*. Support roll 66 is positioned opposite the pressure roll 50, with felt 12 laid out in such a way as to have an angle of winding around pressure roll 50. This leads the web shifted from press center roll 8*a* by belt 55 to be sandwiched between felts and safely transferred to the after process without falling off the belt. Vacuum roll 51 is arranged to kiss fourth press top roll 8*b*, which assures that the web is transported to top roll 8*b* while held up by vacuum force.

Figure 3:
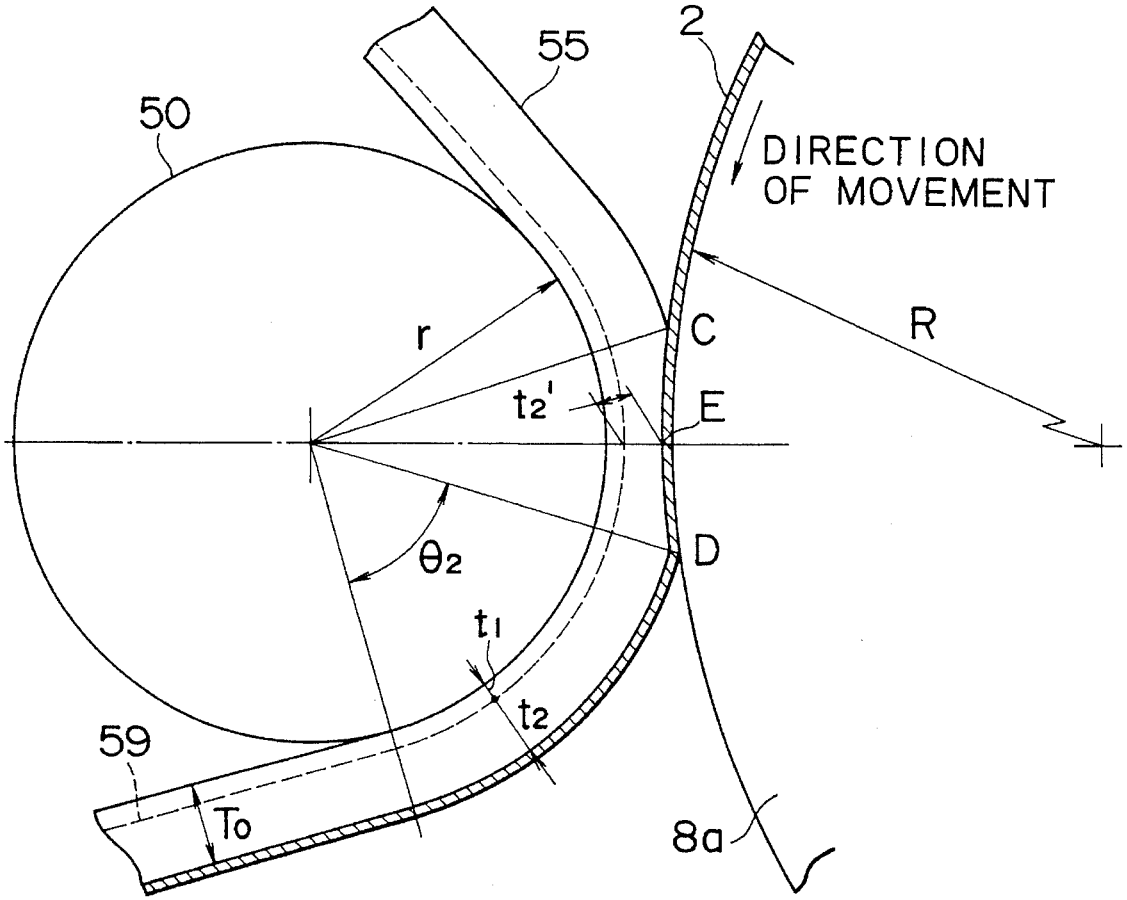
FIG. 3 is an explanatory schematic description of the movement of the web from the hard roll to the belt.

To explain the operations of removing the web in the above-mentioned second example on the basis of FIG. 3, the elastic belt contacts center roll 8*a* in the C–D section, as shown in FIG. 3. The belt that meets the web has a surface speed equal to the web speed on point E where the pressure is maximum. Set the distance from the core under the nip to the surface of the belt meeting the web at $t'_2$ $$\text{Belt core speed} = v \times \frac{R + t_2}{R}$$

In section $\theta_2$, the speed of the surface of the belt that meets the web is:

$$\text{Belt core speed} \times \frac{r + t_1 + t_2}{r + t_1} = V\left(1 + \frac{t_2}{R}\right)\left(1 + \frac{t_2}{r + t_1}\right) > V$$

The surface speed of the belt begins to decrease in the neighborhood of point C on the press center roll where it contacts the web and the speed becomes the same as that of the web on point E where the force pressing on it is at the maximum (the surface of the belt is $t_2$ away from the core). Then the surface of the belt moves faster and, after leaving point D, travels in section $\theta_2$ at the speed calculated below, attaining the necessary volume of draw to peel the web from the press center roll:

$$V\left(1 + \frac{t_2}{R}\right)\left(1 + \frac{t_2}{r + t_1}\right) \neq V\left(1 + \frac{t_2}{r + t_1}\right)$$

In this case, the operations described above are carried out to transfer the web from top roll 8*b* of the fourth press to the next process, the dryer section. In other words, the web transfer device is made up of pressure roll 70, belt drive roll 72, tension roll 73, guide roll 74, belt 75, and vacuum roll 71 inside the dryer canvas loop. The web torn off from top roll 8*a* by the action of belt 75 applied by pressure roll 70, gets sandwiched between canvas 78 and belt 75 and transferred to the canvas by the vacuum action of vacuum roll 71 before it is carried over to the dryer section. Therefore, it is not necessary for the elastic transfer belt 75 to run up to the dryer section.

As described above, in either of the first and second examples, the surface of the elastic belt which meets the web travels constantly while keeping in contact with the web, at the same speed as the web or faster, and as it travels at a higher speed at and after the point of maximum pressure, the surface of the belt is capable of developing enough tension to peel the web from the press center roll although the open draw is kept at zero. In either case, as the surface of the belt has grooves or holes passing through the belt, as shown in FIGS. 4 and 5, air is sucked into the vacuum roll by them through the web, which causes the web to be transferred to the next felt or canvas. The web, produced in the wire section, after it is drawn up by the suction pickup roll, is conveyed to the dryer section together, with the felt or canvas, with no need for any open draw part where only the web is transferred. This is why no paper breakdown occurs. The pressure roll, the belt drive roll, the tension roll, the guide roll and others are all supported by full-width beam 79 with a cantilever and have a convenient construction for belt changes.

One may install shower 80, cleaning roll 81 and doctor 83, as well to clean the belt. As for the method of passing the paper through the dryer section, whose construction does not pass the full breadth of the web, it is permissible to adopt the conventional method of producing a tail in the wire section, passing the tail through the dryer and then expanding it to full-breadth paper. However, the fabrics of the part of tail that has been cut with high pressure water sometimes link up with each other due to the nip in the dryer section. In such a case, you can also install tail-making high pressure water jet 84 after the last press in the press section. Each example in which the invention was actually used shows the elastic belt being pressed against the hard roll by a rotating pressure roll, but there is no need to have the pressure roll rotating. The print is that the part that meets the belt has only to be arch-shaped. The application of a lubricant liquid between the belt and the arch-shaped surface of the pressing device can prevent friction and heating.

As explained at length above, this invention has no open draw between presses or between the press and the dryer sections, which has stood in the way of raising the speed of paper making, consequently reducing paper breakages, and goes a long way toward improving the speed and efficiency of paper making machines. The invention does not involve the traditional operations of passing the paper through the machine, the work which requires considerable skills and takes a long time. This means improved safety and shorter time to set up the paper making machine. In short, the invention greatly helps upgrade the efficiency of the machine.

While the preferred embodiments of the invention have been disclosed in detail, various modifications and adaptations may be made thereto without departing from the spirit and scope of the invention, as delineated in the following claims:

What is claimed is:

1. A web transfer system in a press section of a paper machine, comprising:

an endless belt having a first surface which is elastic and which is structured and arranged to come into direct contact with a web in said press section, and a second surface which is not in contact with said web, wherein said endless belt has an inner core which is located between said first surface and said second surface, which inner core is made from a material which is less elastic than said first surface;

a hard roll for supporting the web; and two pressure rolls which press said endless belt into direct contact with the web and against said hard roll around a sector of said hard roll, wherein when said endless belt is pressed against said hard roll, said endless belt is deformed so as to doff said web from said hard roll directly and convey said web with said endless belt.

2. The web transfer system of claim 1, further comprising a belt drive roll to advance said belt.

3. The web transfer system of claim 2, further comprising a tension roll to supply tension to said belt.

4. The web transfer system of claim 3, further comprising a belt guide roll.

5. The web transfer device of claim 1, further comprising:

a suction roll having plurality of holes on an outer surface thereof, and wherein said belt further has a plurality of grooves which are formed in a web carrying surface of said belt and which, together with said plurality of holes on said outer surface of said suction roll, serve to convey the web to one of a felt and a canvas after the web has been transferred from said hard roll to said belt.

6. The web transfer system of claim 1, further comprising:

a suction roll having a plurality of holes on an outer surface thereof, and wherein said belt further has a plurality of holes which, together with said plurality of holes on said outer surface of said suction roll, serve to convey the web to one of a felt and a canvas after the has been transferred from said hard roll to said belt.

* * * * *